US005289867A

United States Patent [19]

Barker et al.

[11] Patent Number: 5,289,867

[45] Date of Patent: * Mar. 1, 1994

[54] METHOD OF AND APPARATUS FOR COOLING WITH IMPROVED CONTROL SYSTEM

[75] Inventors: George W. Barker; Michael G. Crumpler; James M. Rickett, Jr., all of Carroll County, Ga.; James W. Peters, Cannelton, Ind.; Delmas R. Hughey, Davies County, Ky.

[73] Assignee: Southwire Company, Carrollton, Ga.

[ * ] Notice: The portion of the term of this patent subsequent to Sep. 11, 2007 has been disclaimed.

[21] Appl. No.: 582,291

[22] Filed: Sep. 14, 1990

Related U.S. Application Data

[63] Continuation-in-part of Ser. No. 150,216, Jan. 29, 1988, Pat. No. 4,955,216.

[52] U.S. Cl. ..... 164/455; 72/10

[51] Int. Cl.[5] ..... B21B 37/00; B22D 11/16

[58] Field of Search ..... 72/10, 13, 200, 201; 164/414, 455

[56] References Cited

U.S. PATENT DOCUMENTS

| | | | |
|---|---|---|---|
| 3,358,743 | 12/1967 | Adams | 164/414 |
| 3,766,763 | 10/1973 | Cofer et al. | 72/201 |
| 4,483,387 | 11/1984 | Chielens et al. | 164/414 |
| 4,955,216 | 9/1990 | Barker et al. | 72/10 |

FOREIGN PATENT DOCUMENTS

| | | | |
|---|---|---|---|
| 0028606 | 2/1982 | Japan . | |
| 0139458 | 8/1982 | Japan | 164/414 |
| 1276435 | 12/1986 | U.S.S.R. | 164/414 |
| 8402669 | 7/1984 | World Int. Prop. O. . | |
| 8605724 | 10/1984 | World Int. Prop. O. . | |
| 8800868 | 2/1988 | World Int. Prop. O. | 164/414 |

*Primary Examiner*—Lowell A. Larson
*Assistant Examiner*—Michael J. McKeon
*Attorney, Agent, or Firm*—Stanley L. Tate; James W. Wallis; George C. Myers, Jr.

[57] ABSTRACT

A method and apparatus for automatically adjusting coolant flow rates in casting machines forming a continuous casting and rolling apparatus is disclosed. The rolling mill embodiment is directed to control of soluble oil flow rates to control physical properties of continuously rolled rod, and includes a nozzle for spraying the rod with fluid, a tank for providing the fluid to the nozzle, a valve means in series with the tank for regulating the fluid flow to the nozzle, a controller means connected to and for controlling the valve to ensure that the fluid flow reaches a desired predetermined rate, a computer means connected to and providing said controller with the desired predetermined fluid flow rate, a flowmeter in series with the valve means for measuring the actual fluid flow rate to the nozzle and providing this information to the controller means so that, if necessary, the valve means may be adjusted to achieve the desired predetermined fluid flow rate and an historical data generating means for automatically adjusting said desired predetermined fluid flow rate in accordance with actual measurements of at least one physical property of the rod whose value depends upon the actual fluid flow rate being measured. The casting machine version incorporates a similar control system.

35 Claims, 7 Drawing Sheets

HISTORICAL DATA GENERATOR FLOW DIAGRAM

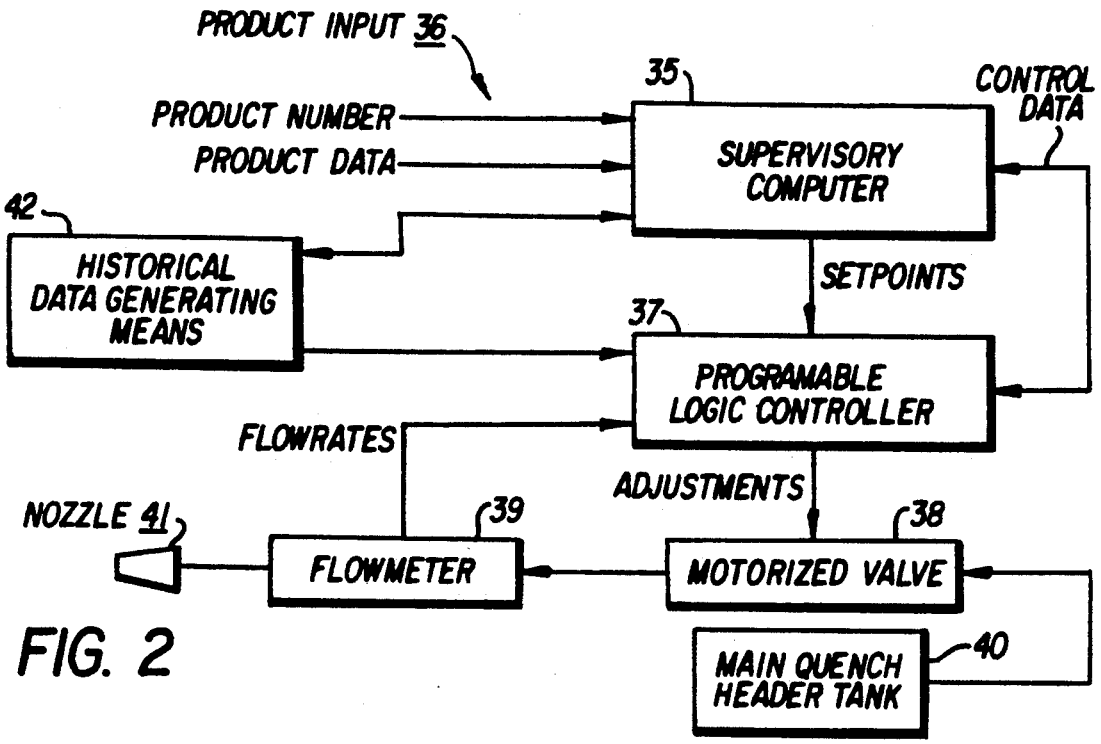
FIG. 2
FIG. 3
PROGRAMABLE LOGIC CONTROLLER FLOW DIAGRAM
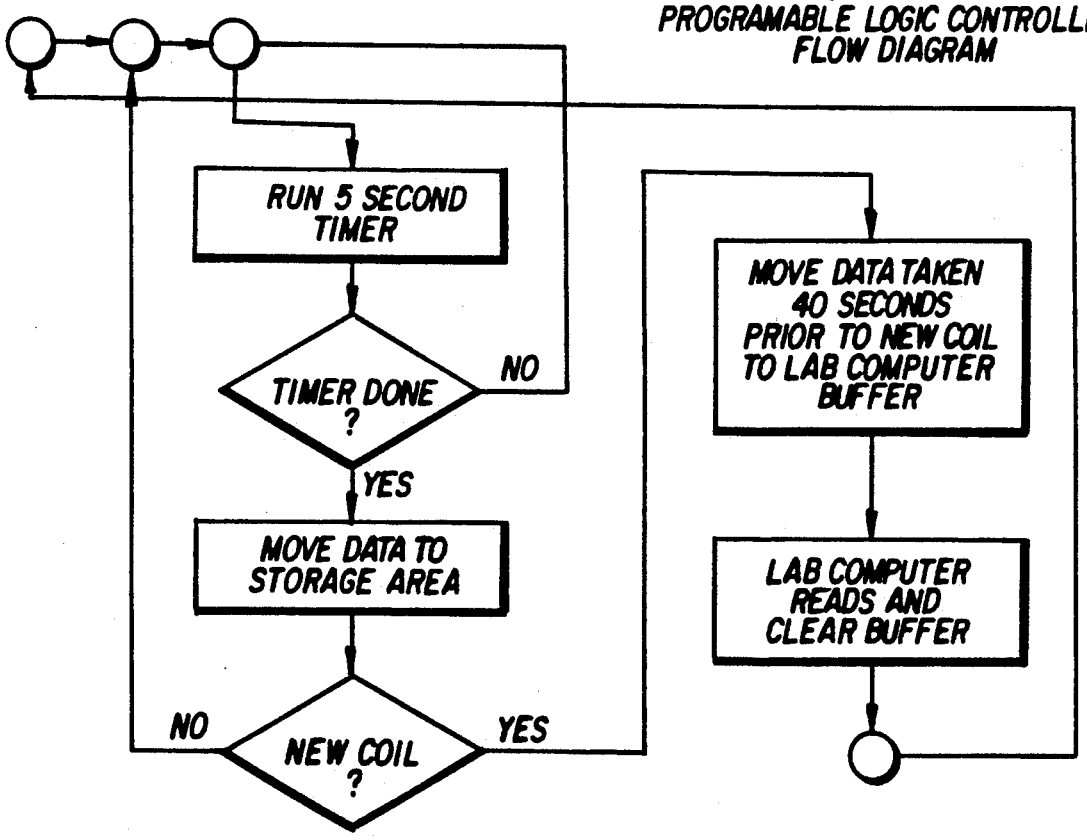

SUPERVISORY COMPUTER FLOW DIAGRAM

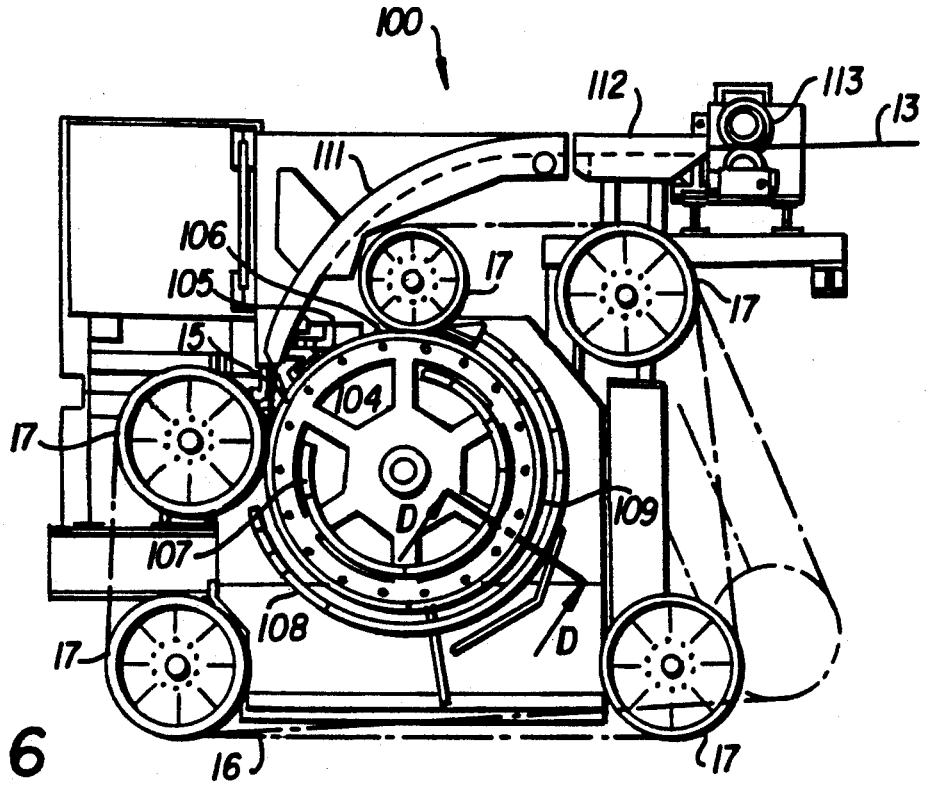
FIG. 6
FIG. 8
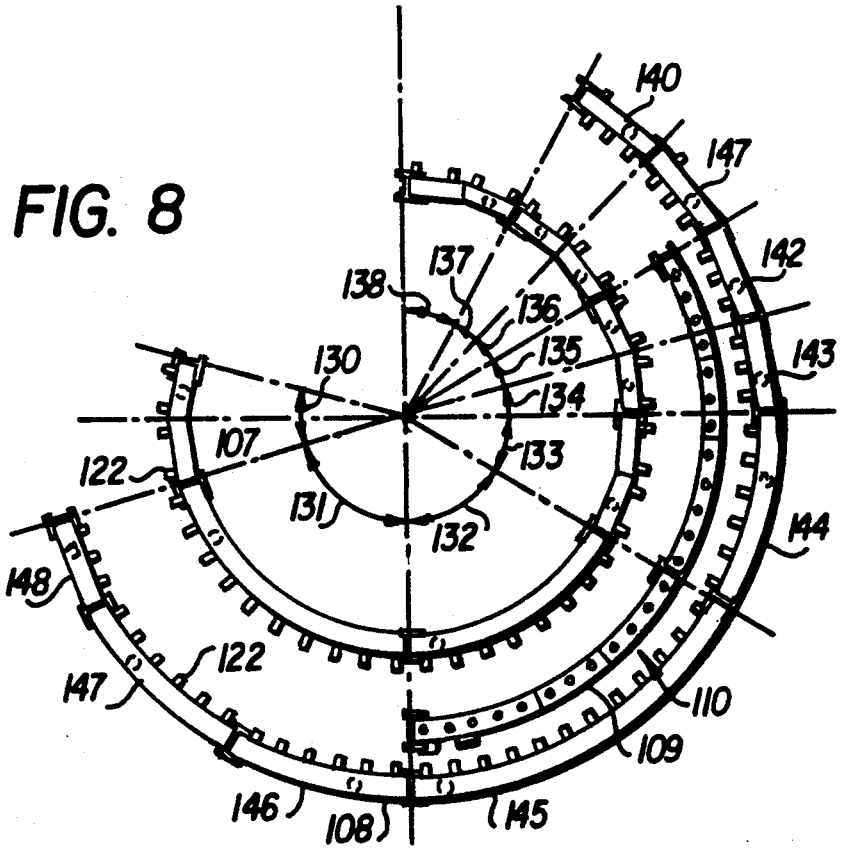

HISTORICAL DATA GENERATOR FLOW DIAGRAM

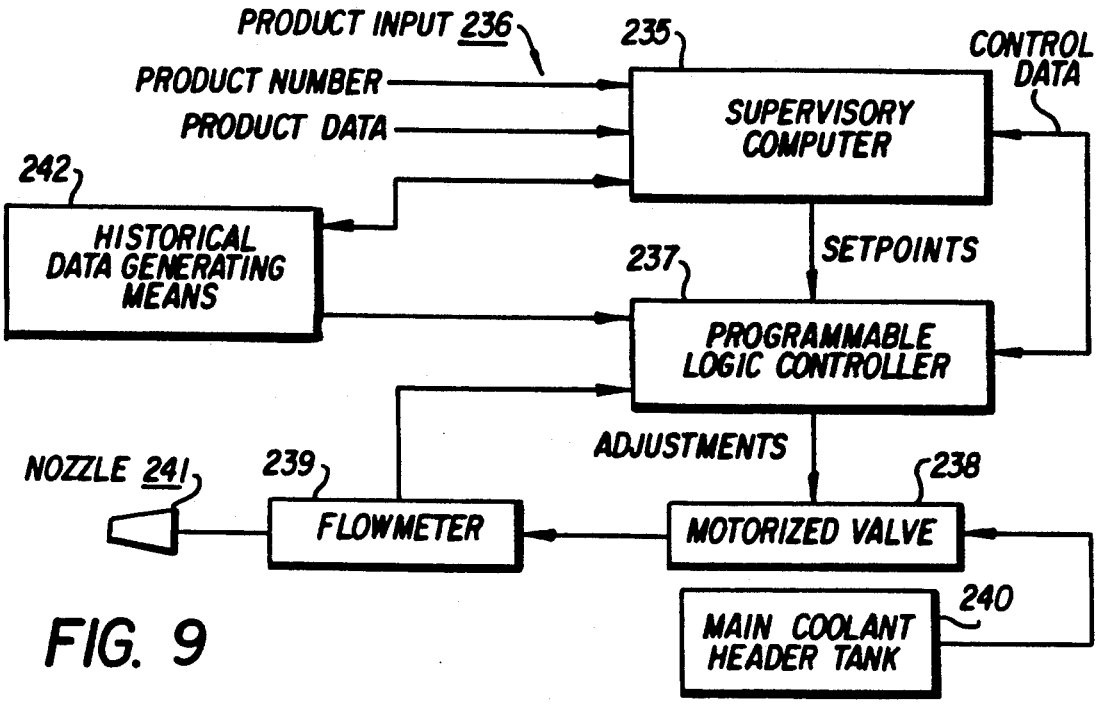
FIG. 9
FIG. 10
PROGRAMMABLE LOGIC CONTROLLER FLOW DIAGRAM
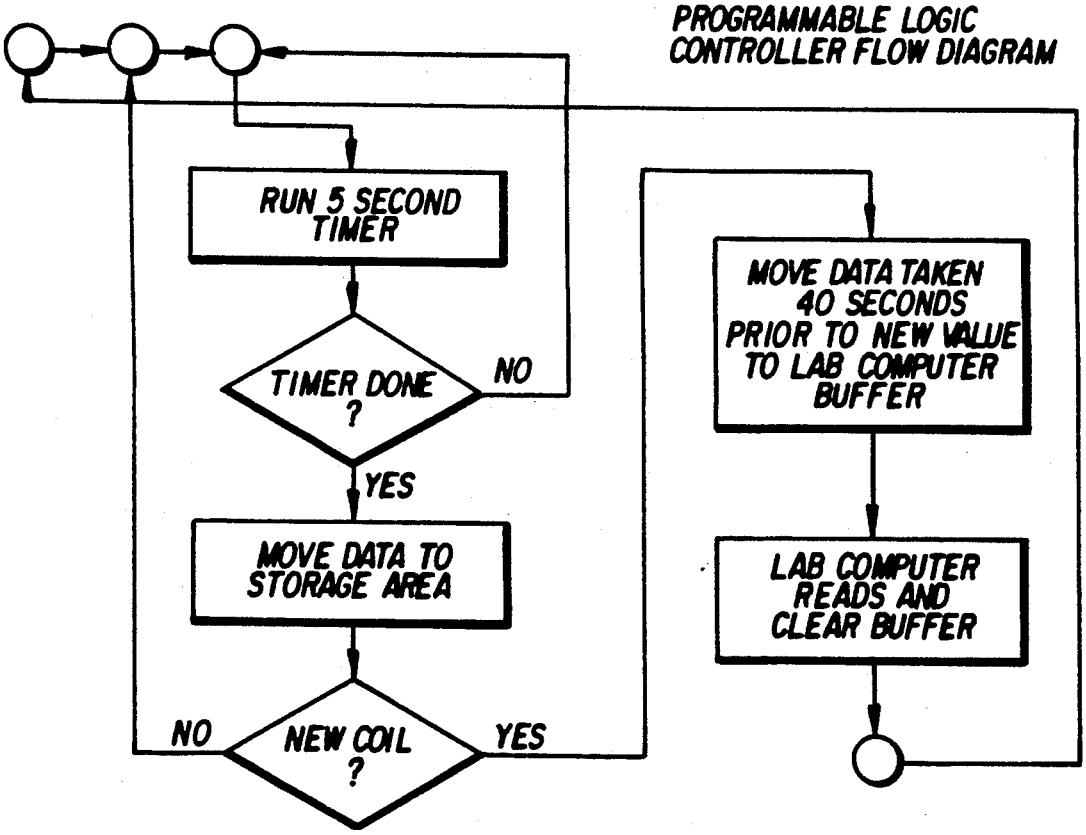

SUPERVISORY COMPUTER FLOW DIARAM

METHOD OF AND APPARATUS FOR COOLING WITH IMPROVED CONTROL SYSTEM

CROSS-REFERENCE TO RELATED APPLICATION

This application is a continuation-in-part of copending U.S. patent application Ser. No. 07/150,216, filed Jan. 29, 1988, now U.S. Pat. No. 4,955,216.

BACKGROUND OF THE INVENTION

This invention relates generally to the continuous casting and rolling of metal rod, more particularly to an automated fluid cooling system for controlling the solidification of a cast bar product and to an automated fluid cooling and lubricating system for metal rod being rolled down from such a continuously cast bar.

In U.S. Pat. No. 3,279,000, entitled Apparatus For Continuous Casting of Metal, which is assigned to the assignee of this invention, there is disclosed a cooling system for a casting wheel wherein a cooling fluid is applied to a wheel-belt casting machine in three zones along the longitudinal pathway of the mold via a plurality of headers collectively supplied coolant under pressure via a main control valve which is paralleled with another coolant valve. A radiation pyrometer is used to control and regulate the flow of coolant to the various headers supplying coolant to the casting wheel via the coolant valve. By controlling the volume of coolant through the coolant valve it was possible to optimize the coolant supply to the casting wheel to provide a cast bar product with more consistent solidification properties than in prior art processes.

In the process disclosed in the aforementioned U.S. Pat. No. 3,279,000 the flow control valves were initially manually preset to achieve a predetermined rate of flow consistent with the desired solidification pattern for the cast bar product being produced, as required for entry into the subsequent step of hot-rolling the cast bar in a rolling mill. Since solidification may vary as a function of the cooling rate of the metal during casting of the bar, it is possible to vary such solidification by changing the settings of the flow control valves. This was accomplished at start-up by the casting machine operator based on his experience with the metal being cast (e.g., copper or aluminum, or alloys thereof). Thus, it was possible to process different metals and alloys, and to produce bar which accommodated the specific rolling mill requirements. The radiation pyrometer and its associated control apparatus was intended to correct for minor variations in cast bar temperature due to fluctuations in the cooling applied to the molten metal in the casting mold. However, the sensor was too slow and imprecise for effective control within the required response time, and the sensed temperature imprecision led to variations in the bar temperature which were often unacceptable.

In U.S. Pat. No. 3,766,763, entitled Continuous Rolled Rod Direct Cooling Method and Apparatus, which is assigned to the assignee of this invention, there is disclosed a cooling and lubricating system for a rolling mill wherein a water-soluble oil solution is provided to cool and lubricate the roll stands of a continuous rolling mill as well as to cool and descale the metal rod being rolled in the mill. The apparatus disclosed in U.S. Pat. No. 3,766,763 included a temperature sensing device located at the downstream end of the rolling mill for constantly monitoring the exit temperature of the rod and flow control valves responsive to the exit temperature for controlling the volume of coolant supplied to the roll stands and rod as it passed through the mill. By controlling the volume of coolant it was possible to optimize the rolling process and produce rod with more consistent metallurgical properties than in prior art processes.

In the process disclosed in the aforementioned U.S. Pat. No. 3,766,763 the flow control valves were manually preset to achieve a predetermined rate of flow consistent with the desired physical properties of the rod being produced, e.g., tensile strength, elongation, and, in the case of electrical conductor (E.C.) rod, conductivity. Since such properties may vary as a function of the cooling rate of the metal during rolling of the rod, it is possible to vary such properties by changing the settings of the flow control valves. This was accomplished manually by the mill operators based on their experience and empirical data. Thus, it was possible to process different metals and alloys, and to produce rod which accommodated the specific specifications of the customer.

In practice, the casting machine operator and the mill operator monitor the actual fluid flow rate and manually adjust the settings on the flow control valves to obtain a flow rate that each operator believes will yield cast bar or rod having the desired physical properties. The rod is then tested for tensile strength, elongation, conductivity, etc. and the flow control valves are manually re-adjusted if the rod properties are not as desired. This process of trial and error continues until the casting machine and mill are producing rod having the desired properties. It should be apparent, however, that it takes substantial time to set the casting machine and mill up correctly with manual valves since the casting machine and the mill must be running at a production rate in order for the flows to be adjusted correctly by the operators. Another problem has been that a large amount of scrap is generated during the set-up period at the start of a particular production run. Still another problem is that each operator on the multiple shift production line may perceive the correct flow rate differently from another operator, causing the rod produced for a particular customer to have inconsistent physical properties. Thus, the prior art manual process was inefficient and uneconomical.

These and other deficiencies in the prior art process have been overcome, in accordance with this invention, through the use of automatic control systems based on historical data of bar and rod previously produced. The automatic control systems are able to adjust the flow control valves during a production run if the bar and rod properties are outside the predetermined tolerance. This ensures that there will be no need to vary flow rates due to the use of different operators. The automatic flow control system is able to respond in the same manner every time, regardless of which operator is monitoring the casting machine and/or mill. This will optimize the corrective action and minimize the amount of out-of-tolerance rod being manufactured. Thus, it can be seen that the automatic coolant flow control systems of this invention are much more desirable than the manual valve and pressure gauge implementation used heretofore by multiple operators. These automatic control systems will reduce scrap rate, provide quality control, and eliminate casting machine and rolling mill down time due to malfunction, customer specification or operator error.

Automatic control systems employing a computer, programmable logic controllers, valves and flowmeters have been used to cast and water cool steel. However, such systems do not control or adjust flow rate on the basis of any historical data of the physical properties of the steel manufactured. Such systems also do not use any historical data to effect a change in variables monitored during the production process in order to obtain the desired physical properties of the metal. U.S. Pat. Nos. 4,483,387; 4,006,633; and 3,915,216 are exemplary of such systems. A computer operated system has also been used in the continuous casting of copper bar. In that system, the monitored variables of cast bar temperature and molten metal level in the casting machine are controlled by a computer.

U.S. Pat. No. 4,569,023 discloses a computerized system for controlling the temperature of metal being rolled into rod in a rolling mill. The system includes an arithmetic device for computing and controlling the rate of flow of cooling water based on the rolling schedule of the mill, the expected temperature of the rod at the inlet to the mill, and the target temperature of the rod at the exit of the mill.

In none of the above systems is control based on the desired physical properties of the final rod product and a measurement of actual physical properties of the final rod product.

SUMMARY OF THE INVENTION

The automatic casting wheel coolant control system of the subject invention is applicable to a number of separate and individual fluid flow loops in the casting machine. Similarly, the automatic rolling mill cooling and lubricating control system of the subject invention is applicable to a number of separate and individual fluid flow loops in the rolling mill. The control system can be applied to both the casting machine and the rolling mill. Adjustment of these loops is accomplished by motorized valves, which adjust flow rate, and flowmeters, which measure actual fluid flow rate. A programmable logic controller continuously monitors the actual fluid flow rate provided by each flowmeter and automatically adjusts each valve position to the correct setting, called a set point, in order to obtain the correct fluid flow rate for each loop.

The flow set point is provided to and maintained in a supervisory computer which receives product identification and product quality information. By use of an algorithm in the supervisory computer, flow strategies for each cast bar and rolled rod product are maintained so that appropriate rod properties are obtained. Furthermore, products may be quickly changed to accommodate each customer's specifications without stopping the mill. Set point adjustments may also be made quickly to correct set points which resulted in the production of rod with undesired properties or to offset process aberrations which may cause a change in the rod properties.

Strategies for a product consist of a list of set points for each product and for each loop in the casting and/or rolling process to adjust flow rate and thus achieve desired rod properties. The strategies are based on actual customer specifications and/or historical data from prior products or ones in actual production. Historical data can be obtained from an historical data generating means, i.e. physical property measuring equipment, modems, and connecting computer, which monitors plant or laboratory equipment measuring physical properties of interest (i.e. tensile strength, elongation, conductivity, etc.) which are affected by fluid flow rates. For example, a tensile measuring machine will measure the tensile strength of the rod over a period of time and provide that information via modem to a computer for transmission to the supervisory computer as historical data. The algorithm to obtain appropriate flow rates to achieve a certain tensile strength may be saved or adjusted by the supervisory computer for future use based on this historical data. This allows the system to be quickly adapted based on measurements taken on the finished product.

In view of the above, it is an object of this invention to obtain the desired physical properties (i.e., cast bar exit temperature) of a cast bar that is subjected to a cooling in a continuous metal bar casting operation and having properties which are affected by the rate of fluid flow being used to cool the cast bar during the solidification process. It is another object of this invention to obtain the desired physical properties (i.e., tensile strength, etc.) of a rod that is subjected to a rolling operation and whose physical properties are affected by the rate of fluid flow being used to cool the rod during the process.

Another object of the invention is to reduce the scrap rate which is obtained when the desired physical properties of the bar or rod have not been achieved.

Still another object of the invention is to reduce the set-up time for the casting machine and for the mill and therefore increase the production time for the manufacture of bar and rod in the mill.

A further object of the invention is to increase the accuracy of the casting and rolling processes being used to manufacture rod so that the physical properties of the rod are uniform throughout the rod.

A more immediate object of the invention is to automatically measure the flow rate which affects the solidification process of the bar being cast.

Another object of the invention is to input historical data into a computer to improve the efficiency and economy of the casting operation by varying the set points for any loop in the coolant flow control process to obtain the specific cast bar temperature required for rolling a particular rod product. Thus, different rod with different characteristics can be made by simply imposing different set points upon the stages of the solidification process. An important aspect of the invention, therefore, lies in the ability of the computer and/or controller to monitor plural flowmeters and valve positions and change set points to efficiently and economically solidify the bar during every stage of the casting process.

A more immediate object of the invention is to automatically measure the flow rate which affects at least the physical property of tensile strength of the rod being manufactured.

Another object of the invention is to input historical data into a computer to improve the efficiency and economy of the rolling operation by varying the set points for any loop in the process to obtain the specific tensile strength desired by a particular customer. Thus, different rod with different tensile strengths can be made by simply imposing different set points upon each operation. The uniqueness of the system, therefore, lies in the computer's and/or controller's ability to monitor plural flowmeters and valve positions and change set points to efficiently and economically manufacture rod at specified tensile strengths or other physical properties during every stage of the manufacturing process.

BRIEF DESCRIPTION OF THE DRAWINGS

FIG. 2 is a block diagram of one spray loop or zone of the automatic control system of this invention;

FIG. 3 is a flow diagram schematically illustrating the functions performed by the programmable logic controller;

FIG. 6 is a side elevation view of an improved casting machine suitable for retrofitting the present invention;

FIG. 8 is a side elevation view of the cooling system of the casting machine embodiment of the present invention;

FIG. 9 is a block diagram of one spray loop or zone of the automatic control system of this invention;

FIG. 10 is a flow diagram schematically illustrating the functions performed by the programmable logic controller;

DETAILED DESCRIPTION OF THE PREFERRED EMBODIMENT

Figure 1:
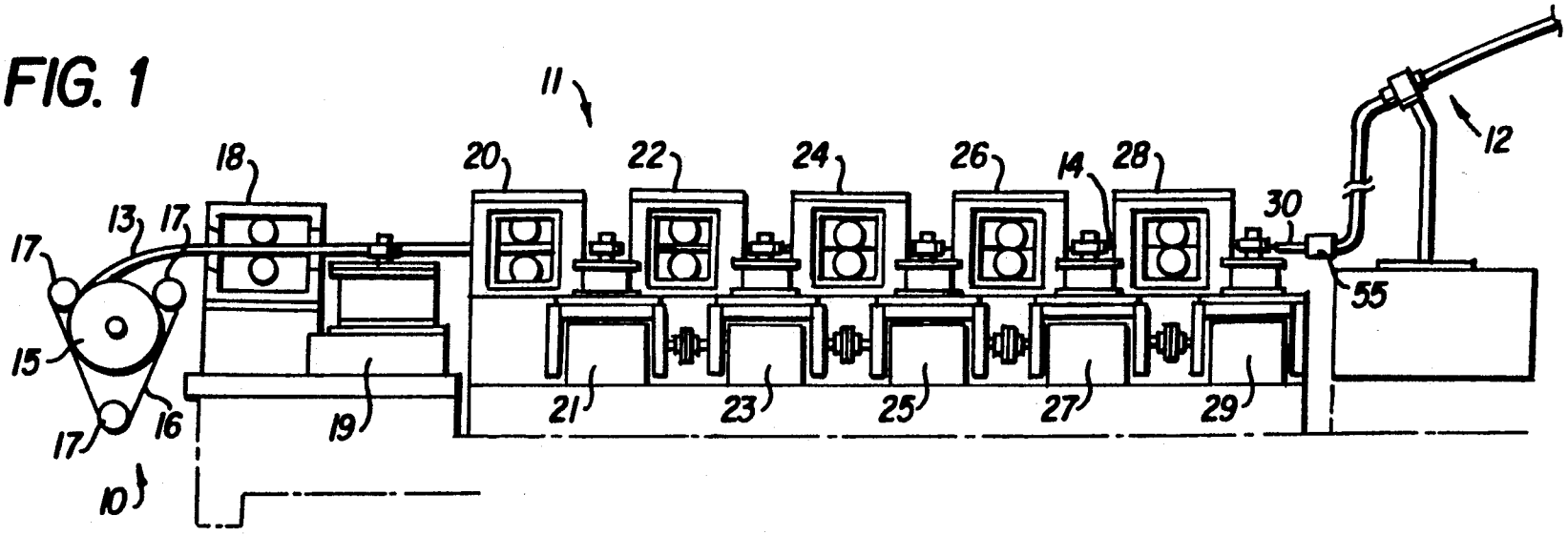
FIG. 1 is a semi-schematic elevation view of rod-manufacturing apparatus including a continuous casting machine, multiple stand rolling mill and pickling apparatus upon which the fluid cooling and lubricating system of this invention is adapted to be utilized.

Referring now to the drawings in detail, there is illustrated in FIG. 1 rod manufacturing apparatus including a continuous casting machine 10, a multiple stand rolling mill 11 and pickling or quenching apparatus 12. The continuous casting machine 10 serves as a casting means for solidifying molten metal to provide a cast metal such as a cast bar 13 that is conveyed in substantially that condition in which it solidified from the continuous casting machine 10 to the rolling mill 11. The rolling mill 11 serves as a hot-forming means for hot-forming the cast bar 13 into a rod 14 of aluminum or another hot-formed aluminum-base product in accordance with the method disclosed in commonly assigned U.S. Pat. No. 3,561,105, or a rod of other hot-formed metal such as copper or steel. It should be understood that while the novel system of this invention is particularly adapted to be used with the apparatus for accomplishing the method disclosed in the commonly assigned U.S. Pat. No. 3,561,105 it is not so limited, and in fact, is useful with hot-forming rolling equipment generally.

The continuous casting machine 10 is of conventional casting wheel type similar to that shown in U.S. Pat. No. 3,318,367 and has a casting wheel 15 with a casting groove (not shown) partially closed by an endless band 16 which is supported against the casting wheel 15 by a plurality of idler wheels 17. The casting wheel 15 and endless band 16 cooperate to provide a mold (not shown) into one end of which molten metal is poured to solidify and form, and out of the other end of which emits the cast bar 13 in substantially that condition in which it solidified.

The rolling mill 11 includes a plurality of roll stands 18 through 29 which are arranged in alternate horizontal and vertical dispositions to hot-form the cast metal by a series of successive deformations. The continuous casting machine 10 and the rolling mill 11 are positioned relative to each other so that the cast bar 13 enters the rolling mill 11 substantially immediately after solidification so as to be in substantially that condition in which it solidified and at a hot-forming temperature within the acceptable range of temperatures for hot-forming cast bar 13. No heating of the cast bar 13 is required between the casting machine 10 and the rolling mill 11, but in the event that it is desired to closely control the hot-forming temperature of the cast bar 13, means for adjusting the temperature of the cast bar (not shown) may be placed between the casting machine 10 and the rolling mill 11.

It will be understood that with the apparatus of FIG. 1, the cast bar 13 may be any of a plurality of lengths determined only by the amount of molten metal available and will extend in the form of a cast bar between the continuous casting machine 10 and the rolling mill 11. It should be thus apparent that the steps of solidifying molten metal to obtain cast metal and of hot-forming the cast metal, as well as the step of pickling (i.e., copper or steel) or cooling the hot-formed cast metal in the pickling or quenching apparatus 12, are generally being performed simultaneously once the apparatus of FIG. 1 is in operation.

During the hot-forming of the rod 14 there is employed a water-soluble oil solution for cooling and lubricating purposes. This oil solution is of suitable concentration according to the type rolling mill and the type metal being rolled into rod. In the preferred embodiment disclosed herein, the water-soluble oil solution is supplied to the mill through a plurality of spray nozzles connected to thirty-two spray loops or zones. It should be understood, however, that any number of such loops or zones may be used within the scope of the invention.

In FIG. 2 of the drawings, one of the thirty-two nozzle spray loops in the rolling stage of the rod manufacturing process is shown. A supervisory computer 35 obtains product inputs 36 to initiate the process. Those inputs may be specification details from a customer (e.g., product identification) or similar data (e.g., quality data, i.e., tensile strength, elongation, etc.) used to predict or obtain the desired rod physical properties. The supervisory computer 35 submits to a programmable logic controller 37, set point information in order to obtain the desired physical properties of the rod. If the set point information is not available, such as at the commencement of the manufacturing of a new product, then a trial and error process occurs until initial set point information can be derived from initial production data. This set point information is in the nature of a valve position or fluid flow rate because either is directly related to the physical properties obtained by the rod. The programmable logic controller 37 utilizes the set point information it receives from the supervisory computer 35 to appropriately set the position of a motorized valve 38 to obtain the appropriate flow rate and hence physical properties of the rod. The motorized valve 38 contains a reversible motor and motor actuated valve. The programmable logic controller 37 receives as a continuous input the position of the motorized valve 38 and actual flow rate information from a flowmeter 39. Thus, the programmable logic controller 37 is knowledgeable, as is the supervisory computer 35, of the desired and actual flow rates for each of the thirty-two loops in the rolling stage of the rod manufacturing process. If the desired flow rate and the actual flow rate are different, then the programmable logic controller 37 adjusts the motorized valve 38 accordingly to obtain the appropriate flow rate. The motorized valve 38 and flowmeter 39 are both located in the stream of soluble oil being pumped from a main quench header tank 40 to a nozzle 41 for spraying of soluble oil on the rod.

When the production of a predetermined length (coil) of rod is completed (taking anywhere from two to ten minutes), a sample of the rod is immediately tested to determine its physical properties. Values corresponding to a particular physical property, e.g., tensile strength, and values corresponding to actual flow rates monitored by the programmable logic controller 37 during the run are then processed by the supervisory computer 35 to determine whether the actual physical property of the rod is within the preset tolerance for the physical property which was input into the supervisory computer 35 at the initiation of the process. If the rod is out of tolerance, the supervisory computer 35, in cooperation with an historical data generating means 42, will calculate a new set point for the programmable logic controller 37 that is expected to bring the physical property into tolerance.

In calculating the new set point the supervisory computer 35 performs an off-line simulation to determine whether certain changes in the flow rate will bring the desired physical property into tolerance. This is accomplished by analyzing the effect of certain incremental changes in the flow rate (either positive or negative) for one or more predetermined cooling loops or zones. Each incremental change is analyzed and compared with historical data stored in the historical data generating means 42 to determine whether the incremental change will result in the desired physical property being in tolerance. If it is not, the next incremental change is analyzed and compared until predetermined limits for the loop or zone under analysis are reached. At that point, the supervisory computer 35 undertakes an analysis of the next loop or zone that it has been programmed to consider, and so on. When the historical data generating means 42 determines that a calculated flow rate will bring the desired physical property into tolerance, then and only then will a signal be sent to the programmable logic controller 37 to change the realtime set point. Thereupon, during production of the next coil of rod, the programmable logic controller 37 will monitor the actual flow rates and, as previously described, control the motorized valves 38 to bring the flow rates into conformance with the new set points.

The foregoing process of rod testing, comparison with historical data, and determination of new set points, if necessary, may be repeated for each coil of rod produced, or at any other predetermined interval, such as after each heat of metal processed. The supervisory computer 35, of course, will not change the set points until new data is entered from the historical data generating means 42.

The supervisory computer 35 is programmed so that it will analyze the effect of given incremental changes in the flow rates of the cooling loops or zones that are expected, based on operating experience, to have the greatest effect on the particular metal being processed. Thus, for example, if the supervisory computer 35 is programmed to analyze four loops, the analytical sequence is arranged in order of priority with the loop most likely to have the greatest effect analyzed first. The particular loops to be analyzed, their number and order of sequence in the program may be varied depending on the particular metal being processed.

The historical data generating means 42 may comprise a direct modem or network hookup and laboratory equipment enabling the laboratory equipment to communicate with the controller means 37 or may include a separate computer or computers which receive the laboratory generated information from operators of the laboratory equipment. These computers would then communicate the laboratory generated information by modem or network output line to controller 37 and then to the supervisory computer 35.

The following variables in the rolling stage are monitored and displayed by the supervisory computer: rod, cast bar, solution, water, and lube oil temperatures; rolling mill motor and extractor pinch roll speeds; soluble oil flow; production rate; and drive motor currents. One or more of these variables can affect the physical properties of the rod during rolling. The supervisory computer 35 can produce a change in value of these variables if the desired physical properties of the rod are not achieved as indicated by the information generated by the historical data generating means 42.

Although the preferred embodiment shown in FIG. 2 includes the programmable logic controller 37, it is within the level of skill in the art after having knowledge of the invention disclosed herein to omit such a controller from the control system and connect the supervisory computer 35 directly to the motorized valve 38 in order to position the valve correctly. In this alternative scheme, all inputs and outputs of the controller 37 would be inputs and outputs to the supervisory computer 35. The reason the programmable logic controller 37 is included in the preferred embodiment is that it contains many more ports than does a supervisory computer and therefore facilitates connection with multiple input/output devices transmitting needed information through the system.

It is also within the level of skill in the art after having knowledge of the invention disclosed herein to combine the flowmeter and motorized valve functions into a single unit. It will also be appreciated that each of or a group of the thirty-two loops in the rolling stage may require different flow rates to achieve precision quality control of the physical properties of the rod. The supervisory computer 35 and programmable logic controller 37 can provide different set points to a number of motorized valves by virtue of the memory contained in each of those units. The supervisory computer 35 can determine, by analysis of the information received from the historical data generating means 42, which of the thirty-two loops should have its set point or flow rate changed and which, if any, of the monitored variables should have its value changed in order to achieve precision quality control of the physical properties of the rod. Thus, the supervisory computer 35 and programmable logic controller 37 can act as centralized units controlling the operation of a number of different loops with different set points and variables with different values to obtain the desired physical properties of the rod manufactured per the above process.

The method of setting the position of the motorized valve 38 may vary also. The feedback loop between motorized valve 38, flowmeter 39, and programmable logic controller 37 may be null seeking, i.e., when the actual parameter and desired parameter are compared and if the difference is not zero an error signal is produced to effect variation of the actual parameter until the difference between the two reaches zero, or may contain positive or negative feedback to reach the appropriate valve position without needless oscillation. Alternatively, the valve position may be directly set by the controller 37 without concern for positive, negative, or null seeking feedback.

Figure 4:
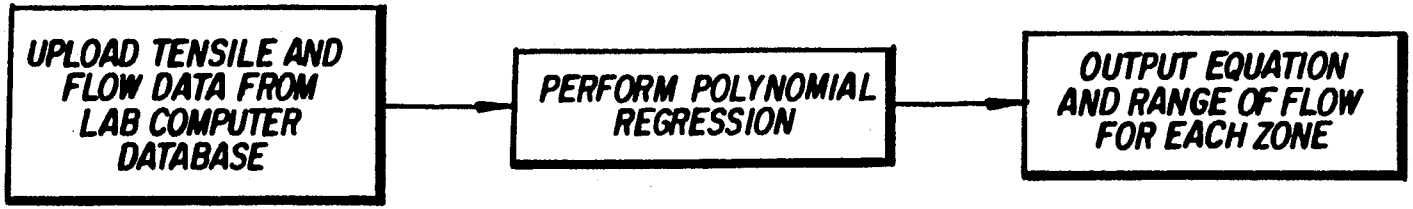
FIG. 4 is a flow diagram schematically illustrating the functions performed by the historical data generator.
Figure 5:
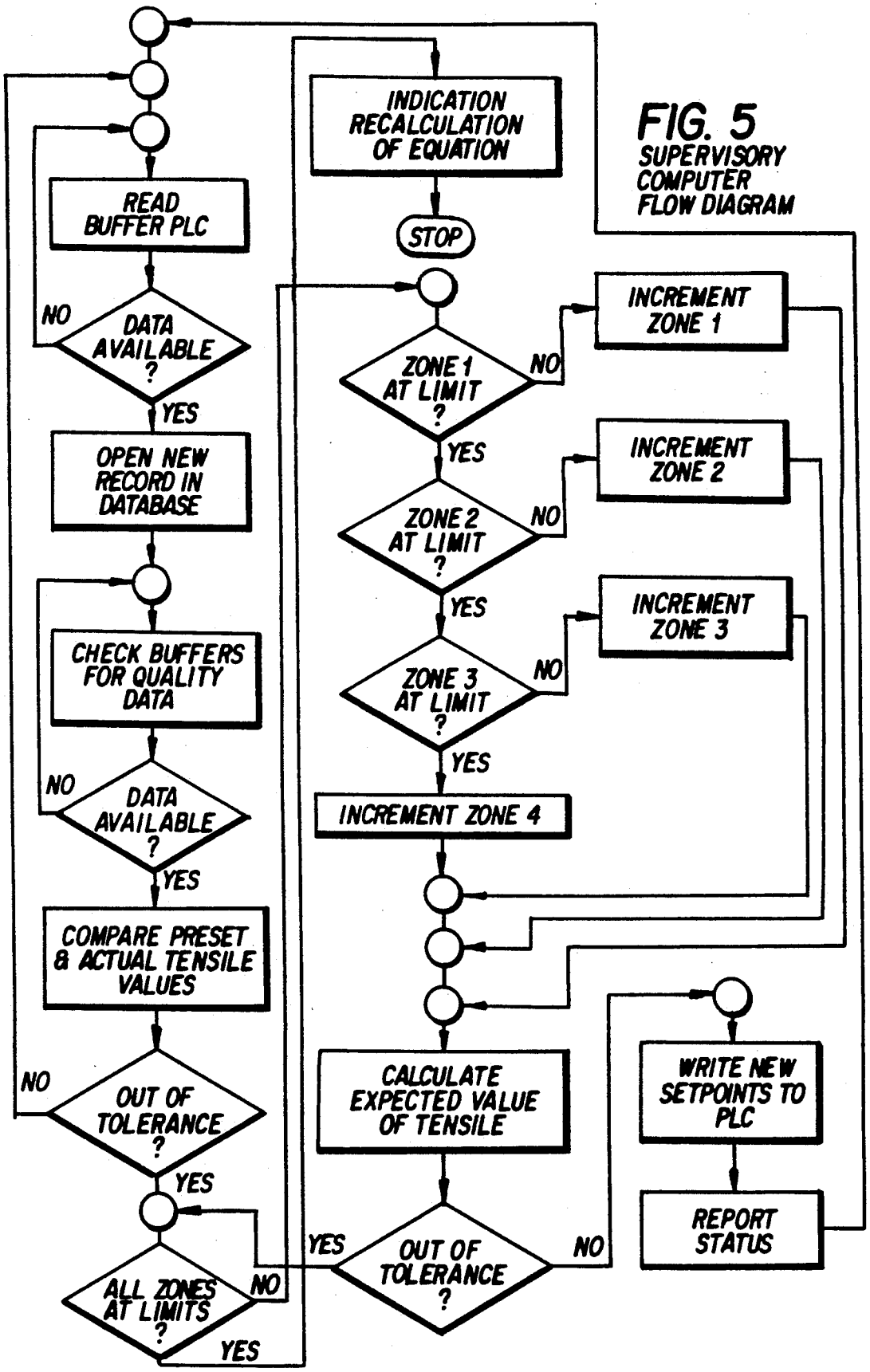
FIG. 5 is a flow diagram schematically illustrating the functions performed by the supervisory computer.

Referring now to FIGS. 3, 4, and 5, there are illustrated flow diagrams for the programmable logic controller 37, the historical data generating means 42, and the supervisory computer 35 relating to one exemplary system involving measurement and control of rod tensile strength. The steps performed by the programmable logic controller 37 in carrying out its data collection function are shown in FIG. 3 as follows:

A. Initial data collection is made by the programmable logic controller at 5 second intervals, and stored in a file.
   1. Data is defined as the actual flow of a particular flow loop.
   2. Supervisory Computer setpoint controlled Flow loops have been preselected based on past experience of operators at trimming the rod mill flows to adjust rod tensile strength.
   3. Supervisory Computer setpoint controlled Flow Loops are the 4 Flow Loops most often used to trim the rod tensile strength.

B. Run timer beginning at the start of each new rod coil, and continuing until rod coil is complete.

C. Move data values stored 40 seconds before end of rod coil to Supervisory Computer read buffer area.

D. Supervisory Computer reads data and stores it, associated with stock and rod coil serial number.

E. Coil sample is analyzed in lab, and quality data including rod tensile strength, is placed into database located in the File Server with associated flow data from the programmable logic controller (in (D). above).

The steps carried out by the historical data generating means 22 in performing its data analysis function are shown in FIG. 4 as follows:

A. Data analysis is performed upon request by the Historical Data Generator having access to the database stored in the File Server, so as not to interfere with continuing data collection.
   1. Data analysis is based upon stock number.
   2. Request for a certain stock number to be analyzed is made by the Historical Data Generator operator.

B. The analysis program uploads database information from the File server as follows:
   1. Tensile strength for each rod coil serial number;
   2. Supervisory Computer setpoint controlled Flow Loop number, and flow data for each rod coil serial number.

C. A seventh order multivariate polynomial regression is made on the data from (b).
   1. The dependent variable is rod coil sample tensile strength.
   2. The independent variables are the flows.

D. The generated equation is of the form:

$$t(0 \ldots f_z) = a_0 + a_1f_0 + a_2f_0^2 + a_3f_0^3 + \ldots + a_7f_0^7 + b_1f_1 + b_2f_1^2 + b_3f_1^3 + \ldots + b_7f_1^7 + c_1f_2 + c_2f_2^2 + c_3f_2^3 \ldots + c_7f_2^7 + \ldots + z_1f_z + z_2f_z^2 + z_3f_z^3 + \ldots + z_7f_z^7$$

E. The equation is then printed, along with the maximum range of coolant flow experienced by each Flow Loop.

After the foregoing equation is determined, the system operator then performs the following steps:

A. The set point equation and the Flow Loop maximum ranges are reviewed by the operator.
   1. The operator checks to see that the Flow Loop maximum ranges are reasonable.
   2. The operator substitutes flow information into the equation to insure that reasonable results are obtained.

B. If a problem is found, then the database information is reviewed, and problem records are deleted before recalculating the equation.

C. The equation is then loaded by product or stock number into the Supervisory Computer for real-time set point control.

D. The operator also loads the maximum allowable control ranges for each Flow Loop, as well as the Flow Loop priority (i.e., the order in which to change the Flow Loop set points).

The steps performed by the supervisory computer 35 in controlling the set points as shown in FIG. 5 are as follows:

A. The Supervisory Computer checks to see if a newly entered rod coil sample tensile strength value is within tolerance.

B. If it is not, the Supervisory Computer calculates the error which is the difference between the desired value of rod coil sample tensile strength and the actual value.

C. The Supervisory Computer then checks to see if all zones are at their control limits, and aborts if they are (see (J)).

D. If not (C), and the error is positive, a positive increment is selected to calculate the new set point for the controlled zones.

E. If not (C), and the error is negative, a negative increment is selected to calculate the new set point for the controlled zones.

F. The Supervisory Computer increments the highest priority Flow Loop set point by 1 gpm and recalculates the expected value of rod coil sample tensile strength.

G. If the expected value is not within tolerance, the error is recalculated by subtracting the actual value from the expected value.

H. Step (F) is repeated until the zone reaches the maximum allowable control range, or the expected value of rod coil sample tensile strength is within tolerance.

I. If the highest priority zone reaches the maximum allowable control range, the zone with the next highest priority is selected.

J. If all control zones reach their respective maximum allowable control ranges, and the expected value of rod coil sample tensile strength is still not within tolerance, then no more adjustments are made until the operator resets the automatic operation.

K. If the expected value of rod coil sample tensile strength is within tolerance, and all zones are not at their maximum control limits, the realtime zone set points are incremented by the calculated amounts, and no more adjustments are made until another rod coil sample tensile value is entered.

The preferred embodiment above describes exemplary structure for performing specific tasks in the rod milling process. In practice, it has been found that a Texas Industrial Microsystems IPC 2000 series computer is sufficient to perform the tasks of the supervisory computer 35. The IPC 2000 is a rugged mounted computer designed for industrial process control and factory automation. It has 8 full size personal computer compatible expansion slots for input/output, a system board 640K memory, and an Intel 8088/8087 processor. It has also been found that an Allen-Bradley PLC-2/30 programmable logic controller is sufficient to perform the tasks of the programmable logic controller 37. During program operation, the PLC-2/30 programmable logic controller, through its processor, continuously monitors the status of input devices and, based on user program instructions, either energizes or de-energizes output devices such as electrically actuated valves. Because the memory is programmable in the PLC-2/30, the user program can be readily changed if required by the application. The PLC-2/30 programmable logic controller has a memory capacity of 16,256 words and an 896 input/output device capacity.

It has also been found that a suitable motorized valve 38 is a Worcester Controls electronic control valve which is comprised of a Worcester 73/75 actuator, which is coupled to a valve stem and has the power to open, close, or throttle the valve, and an AF-17 autoflow electric positioner, which receives a message from a controller and interprets and transmits that message to the actuator to correct its position. A suitable flowmeter is a Fisher & Porter Mini-MAG magnetic flowmeter whose meter body is a sealed section that bolts between the manufacturer's pipeline flanges. The measuring electrodes that contact the process fluid have their ends flush with the inside of the liner which is turned out against the flange faces. A signal connector may also be used with the flowmeter to transmit the metered signal to a computer or controller.

Figure 7:
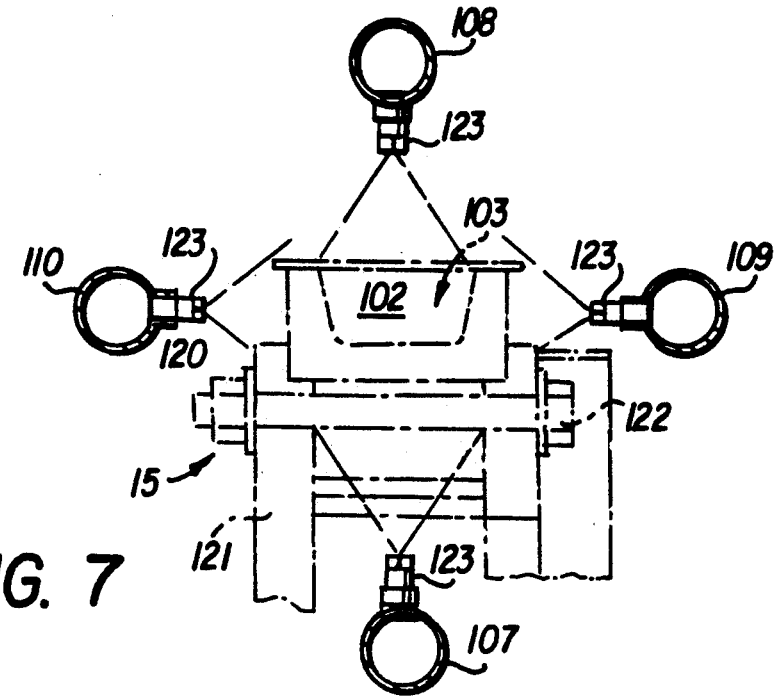
FIG. 7 is a cross-section view of a portion of the apparatus of FIG. 6, showing the casting mold.

In an alternative embodiment, cooling system control may also be applied to a continuous casting machine, separately or in combination with the rod mill soluble oil control system described above. Referring now to FIGS. 6–8, a more detailed view of an improved continuous metal casting machine 100 is shown, including a rotatable casting wheel 15 having an annular groove 103 (FIG. 7) therein, a band 16 at least partially encircling the casting wheel 15 and being routed around a plurality of idler and/or tension wheels 17 which serve to hold the band 16 firmly against the wheel 15 and seal it against leakage. Wheel-band casting machines are known which have as few as two such idler/tension wheels and as many as five or six idler/tension wheels. Typically, three to five are used in current models. The band 16 thus encloses an elongated mold 102 (see FIG. 7) formed of the band 16 and the groove 103. In operation, wheel 15 is rotated on its axis 104 and molten metal from a pour pot 105 or equivalent source is introduced into the mold via a pour spout 106. The flow rate of molten metal and rotation speed of the casting wheel, and thus the mold, are coordinated to ensure the mold is filled but not overfull as it rotates. A conveyor mechanism 111 supports and guides the cast product away from and over the casting machine 10, past a movable end portion 112 of the conveyor 111 to pinch rolls 113 (which may be driven, as desired) to feed the cast bar 13 into the rolling mill 11. Such casting machines are well-known in the art.

The casting wheel 15 (see FIG. 7) may be described for the present purposes as comprising an annular grooved ring 120 attached to a spoked frame 121 by a plurality of fasteners which may include threaded fasteners 122 or the equivalent. Coolant is supplied to the casting machine area via one or more main coolant supplies which supply a plurality of manifolds 107–110 adjacent the casting ring. To each of the manifolds 107–110 are attached a multiplicity of spray nozzles 123. Spray nozzles 123 direct coolant onto the rear and side faces of ring 120 and to the band 103 forming the mold, cooling and solidifying the molten metal inside the mold as the wheel rotates, advancing the mold towards an exit. As the mold rotates through an angle from the point of molten metal entry adjacent the pour spout 106 to the end of the mold cavity at the point where the band 16 is removed from the wheel 15 by an idler/tension wheel 17, the degree of cooling and thus the amount of coolant applied to the mold ordinarily varies with a number of factors, including the production rate and capacity of the machine, the metal being produced, and the alloy. These factors are generally well-known in the art.

To assist in controlling the cooling process, the mold path length is divided into a plurality of zones of coolant control. For this reason, the various manifolds 107–110 may be segmented (see also FIG. 8) along their respective lengths corresponding to angles with respect to the beginning of the mold or a standard angle, such as the "12 o'clock" position at the top of the wheel, as in the present example. The respective zones need not correspond exactly to the segments of one or more of the manifolds.

In the present example illustrated, the mold path is divided into nine zones 130–138 of varying arcuate extent. The manifolds 107–110 are divided into segments corresponding to a plurality of coolant zones. Note that an additional zone is provided by wheel manifold 107 which extends past the beginning of manifold 108 segment 140 towards the mold beginning. Another zone formed by wheel manifold 107 extends past the end of manifold 108 segment 148. Thus, the manifold lengths and segments need not correspond exactly with the cooling zones.

It should be understood that the curved mold formed by the groove and band is elongated and thus has an axis along the curved path, hereinafter described as the "longitudinal axis" of the mold or cast bar. Certain metals and especially certain alloys, such as electrically conductive aluminum alloys, require very careful adjustment of the cooling applied to the mold along, as well as about, its longitudinal axis, and this rate of cooling differs between the relatively slower rotational rates at startup, and the relatively high speeds of normal production. It is preferred that the cooling be uniform about this curved longitudinal axis. In order to minimize waste bar product at startup and until normal production operating speeds are reached, careful control of the application of coolant to the mold is critical. The solidification process occurs over time while moving from molten metal (which may contain superheat) to a solid cast bar 13 product at a given target temperature for entry into a rolling mill 11 as described hereinbefore. For a given transverse section of cast bar the application of cooling over time, and thus the solidification process to which the bar has been subjected, is described herein as the 'solidification history', of that section of bar.

The startup cooling adjustment process is complicated by the fact that each product cast on a given casting machine requires a different solidification history as it enters the rolling mill 11. Production of high-grade rolled rod is not achieved until the casting process continuously produces a cast bar of the desired solidification history and meeting the target characteristics for entry into the rolling mill. The startup process heretofore relied largely on the knowledge, skill, and expertise of the casting machine operator.

The continuous casting machine 10 which thus serves as a casting means for solidifying molten metal in this example is a wheel-band continuous casting machine. It should be understood that while the novel system of this invention is particularly adapted to be used with the wheel-band apparatus for continuous casting of molten metals, it is not so limited, and in fact, is useful with molten metal casting equipment generally.

The present casting wheel cooling control system is capable of providing a wide range of cast bar delivery temperatures so that the cast bar 13 enters the rolling mill 11 substantially immediately after solidification in substantially that condition in which it solidified and at a hot-forming temperature within the acceptable range of temperatures for hot-forming cast bar 13. While heating of the cast bar 13 is not normally required between the casting machine 10 and the rolling mill 11, in the event that it is desired to adjust the hot-forming temperature of the cast bar 13, means for adjusting the temperature of the cast bar (not shown) may be placed between the casting machine 10 and the rolling mill 11.

During the cast bar solidification process, a multiplicity of individual spray nozzles are ordinarily required. They are grouped together by manifold segments in the present illustrative embodiment, and the manifolds are coupled to controlled coolant supply sources. Controlling these many sources of coolant spray onto the casting mold may require a great many process control loops, generally corresponding to the cooling zones described hereinbefore. In the preferred embodiment disclosed herein, any number of such control loops or cooling zones may be used within the scope of the invention.

In FIG. 9 of the drawings, one of the many cooling spray control loops is shown for illustrative purposes. The control loops may be divided into primary control loops for headers supplying the manifolds 107–110 and secondary control loops for the zones 130–138 or the illustrated segments 140-148. A supervisory computer 235 obtains product inputs 236 to initiate the casting process. Those artisans skilled in the computer arts will recognize here that while a single computer 235 may be used in this application, a plurality of computers may also be used, particularly where the number of process points and control loops to be contrilled complicates the control systsem. As with the rolling mill control process described hereinbefore, those inputs may be specification details from a customer (e.g., product identification) and/or cast bar data (e.g., bar solidification history, cast bar temperature, or rod quality data, e.g., tensile strength, elongation, etc.) used to predict or obtain the desired cast bar characteristics required to produce the desired rod properties. The supervisory computer 235 submits to a programmable logic controller 237, set point information in order to obtain the desired solidification history and cast bar temperature. If the set point information is not available, such as at the commencement of the manufacturing of a new product, then a trial and error process occurs until initial set point information can be derived from initial production data. This set point information (for each controlled loop) may be in the nature of a valve position or fluid flow rate because they are directly related to the solidification history and the cast bar temperature. The programmable logic controller 237 utilizes the set point information it receives from the supervisory computer 235 to appropriately set the position of a motorized valve 238 to obtain the appropriate flow rate. The motorized valve 238, as is known in the process control field, contains a reversible motor and motor actuated valve. The programmable logic controller 237 receives as continuous input the position of the motorized valve 238 and actual flow rate information from a flowmeter 239. Thus, the programmable logic controller 237 is knowledgeable, as is the supervisory computer 235, of the desired and actual flow rates for each of the many control loops in the casting stage of the bar production process. If the desired flow rate and the actual flow rate are different, then the programmable logic controller 237 adjusts the motorized valve 238 accordingly to obtain the appropriate flow rate. The motorized valve 238 and flowmeter 239 are both located in the stream of coolant supplied the manifolds 107-110, segments 140–148, or the nozzles 123 for spraying of coolant against the mold 102.

The primary cast bar characteristic measured is the bar temperature. However, it is recognized that with certain metals, such as aluminum and aluminum alloys, and certain sensors, such as radiation temperature sensors, the cast bar emissivity may present problems of temperature control in that the sensed variable, temperature, may be slow or unreliable. In such cases, the sensed bar temperature value may require further signal processing, such as averaging, reliance on alternate sensors, or predictive signal processing. In some circumstances, it may be necessary to rely on data collected from the rolling mill quench control system described above in order to infer variables which can then be supplied to the casting machine coolant control system for casting machine control.

The sensed or otherwise determined bar temperature and/or solidification history information can be stored, and a sample of either the bar or the rod promptly tested to determine its properties. Values corresponding to a particular cast bar temperature and values corresponding to actual coolant flow rates monitored by the programmable logic controller 237 during the casting process may then be processed by the supervisory computer 235 to determine whether the actual cast bar temperature or rod property is within the preset tolerance for the bar temperature or rod physical property which was input into the supervisory computer 235 at the initiation of the process. If the cast bar temperature is out of tolerance, the supervisory computer 235, in cooperation with an historical data generating means 242, will calculate a new set point for the programmable logic controller 237 that is expected to bring the temperature into tolerance.

In calculating the new set point, the supervisory computer 235 performs an off-line simulation to determine whether certain changes in the coolant flow rate will bring the cast bar temperature into tolerance. This is accomplished by analyzing the effect of certain incremental changes in the casting machine coolant flow rate (either positive or negative) for one or more of the cooling loops or zones. Each incremental change is analyzed and compared with historical data stored in the historical data generating means 242 to determine whether the incremental change will result in the desired cast bar temperature coming into tolerance. If not, the next incremental change is analyzed and compared until predetermined limits for the loop or zone under analysis are reached. At that point, the supervisory computer 235 undertakes an analysis of the next loop or zone that it has been programmed to consider, and so on. When the historical data generating means 242 determines that a calculated flow rate will bring the desired cast bar temperature into tolerance, then and only then will a signal be sent to the programmable logic controller 237 to change the realtime set point. Thereupon, during production of the next coil of rod, the programmable logic controller 237 will monitor the actual flow rates and, as previously described, control the motorized valves 238 to bring the flow rates into conformance with the new set points.

The foregoing process of cast bar temperature measurement, whethor or not combined with rod testing, comparison with historical data, and determination of new set points, if necessary, may be repeated for each section of cast bar or coil of rod produced, or at any other predetermined interval, such as after each heat of metal processed. The supervisory computer 235, of course, will not change the set points until new data is entered from the historical data generating means 242.

The supervisory computer 235 is programmed so that it will analyze the effect of given incremental changes in the flow rates of the cooling loops or zones that are expected, based on operating experience, to have the greatest effect on the particular metal being processed. Thus, for example, if the supervisory computer 235 is programmed to analyze four loops, the analytical sequence is arranged in order of priority with the loop most likely to have the greatest effect analyzed first. The particular loops to be analyzed, their number and order of sequence in the program may be varied depending on the particular metal being processed.

The historical data generating means 242 may comprise a direct modem or network hookup and laboratory equipment enabling the laboratory equipment to communicate with the controller means 237 or may include a separate computer or computers which receive the laboratory generated information from operators of the laboratory equipment. The present invention comprehends use of a single computer to control the casting machine, rod rolling mill, and laboratory functions, or separate computers for one or more of these site functions. These computers would then communicate the laboratory generated information by modem, network output line, or the equivalent to controller 237 and then to the supervisory computer 235.

The following variables in the casting machine are monitored and displayed by the appropriate computer: production rate/casting speed, cast bar temperature, water temperature and flow rates, and extractor pinch roll speeds; production rate; and drive motor currents. Additional variables may be selected as needed. One or more of these variables affect the cast bar temperature and solidification history. The supervisory computer 235 can produce a change in value of these variables if the desired cast bar temperature and/or the physical properties of the rod are not achieved as indicated by the information generated by the historical data generating means 242.

Using a supervisory computer in control of programmable logic controllers as described may be referred to as distributed control. Although the preferred embodiment shown in FIG. 9 includes the programmable logic controller 237 in a distributed control configuration, it is within the level of skill in the art after having knowledge of the invention disclosed herein to omit such a controller from the control system and connect the supervisory computer 235 directly to the motorized valve 238 in the direct digital control configuration in order to position the valve correctly. In this alternative scheme, all inputs and outputs of the controller 237 would be inputs and outputs to the supervisory computer 235. The reason the programmable logic controller 237 is included in the preferred embodiment is that it contains many more ports than does a supervisory computer and therefore facilitates connection with multiple input/output devices transmitting needed information through the system.

It is also within the level of skill in the art after having knowledge of the invention disclosed herein to combine the flowmeter and motorized valve functions into a single unit. It will also be appreciated that each of or a group of the coolant control loops in the casting machine may require different flow rates to achieve precision control of the solidification history of the rod. The supervisory computer 235 and programmable logic controller 237 can provide different set points to a number of motorized valves by virtue of the memory contained in each of those units. The supervisory computer 235 can determine, by analysis of the information received from the historical data generating means 242, which of the many coolant control loops should have its set point or flow rate changed and which, if any, of the monitored variables should have its value changed in order to achieve precision control of the cast bar temperature and/or the physical properties of the rod. Thus, the supervisory computer 235 and programmable logic controller 237 can act as centralized units controlling the operation of a number of different loops with different set points and variables with different values to obtain the desired product manufactured according to the above process.

The method of setting the position of the motorized valve 238 may vary also. The feedback loop between motorized valve 238, flowmeter 239, and programmable logic controller 237 may be null seeking, i.e., when the actual variable and the desired variable values are compared, if the difference is not zero an error signal is produced to effect variation of the actual parameter until the difference between the two reaches zero, or may contain positive or negative feedback to reach the appropriate valve position without needless oscillation. Alternatively, the valve position may be directly set by the controller 237 without concern for positive, negative, or null seeking feedback.

Figure 11:
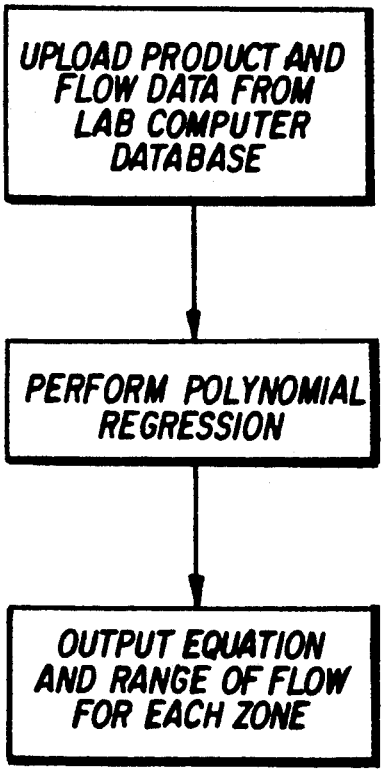
FIG. 11 is a flow diagram schematically illustrating the functions performed by the historical data generator.
Figure 12:
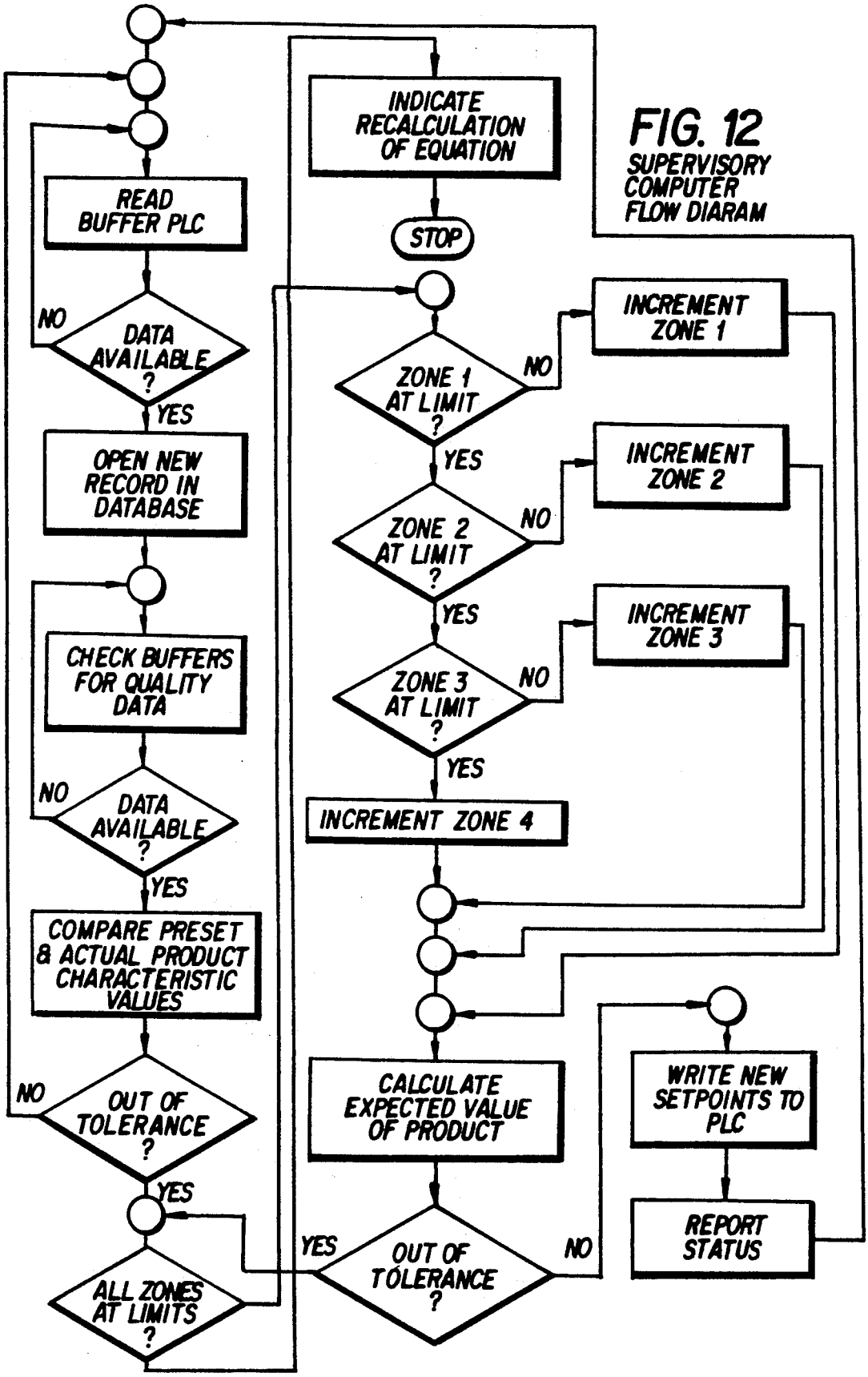
FIG. 12 is a flow diagram schematically illustrating the functions performed by the supervisory computer.

Referring now to FIGS. 10–12, there are illustrated flow diagrams for the programmable logic controller 237, the historical data generating means 242, and the supervisory computer 235 relating to one exemplary system involving measurement and control of cast bar temperature. The steps performed by the programmable logic controller 237 in carrying out its data collection function are shown in FIG. 10 as follows:

A. Initial data collection is made by the programmable logic controller at periodic intervals, and stored in a file.
   1. Data is defined as the actual flow of a particular coolant flow loop.
   2. Supervisory Computer set point controlled flow loops have been preselected based on past experience of operators at trimming the casting machine coolant flows to adjust solidification history and cast bar exit temperature.
   3. Supervisory Computer set point controlled flow loops are the flow Loops most often used to trim the cast bar temperature.

B. Run timer beginning at the start of each period, and continuing until the period is complete.

C. Move data values stored shortly before end of the period to Supervisory Computer read buffer area.

D. Supervisory Computer reads data and stores it, associated with stock and cast bar product, and with rod coil serial number if desired.

E. Cast bar temperature sensed value (and/or rod coil sample values determined in lab, and quality data) is placed into database located in the File Server with associated flow data from the programmable logic controller (in Step D above).

The steps carried out by the historical data generating means in performing its data analysis function are shown in FIG. 11 as follows:

A. Data analysis is performed upon request by the Historical Data Generator having access to the database stored in the File Server, so as not to interfere with continuing data collection.
   1. Data analysis is based upon variables related to a given product or stock number.
   2. Request for a certain product or stock number to be analyzed is made by the Historical Data Generator operator.

B. The analysis program uploads database information from the File server as follows:
   1. Cast bar temperature and/or solidification history;
   2. Supervisory Computer set point controlled Flow Loop number, and flow data for cast bar temperature.

C. A seventh order multivariate polynomial regression is made on the data from (B).
   1. The dependent variable is cast bar exit temperature.
   2. The independent variables are the coolant flows.

D. The generated equation is of the form:

$$t(0 \ldots f_z) = a_0 + a_1f_0 + a_2f_0^2 + a_3f_0^3 + \ldots + a_7f_0^7 + b_1f_1 + b_2f_1^2 + b_3f_1^3 + \ldots + b_7f_1^7 + c_1f_2 + c_2f_2^2 + c_3f_2^3 \ldots + c_7f_2^7 + \ldots + z_1f_z + z_2f_z^2 + z_3f_z^3 + \ldots + z_7f_z^7$$

E. The equation is then printed, along with the maximum range of flow experienced by each Flow Loop.

After the foregoing equation is determined, the system operator then performs the following steps:

A. The set point equation and the Flow Loop maximum ranges are reviewed by the operator.
   1. The operator checks to see that the Flow Loop maximum ranges are reasonable.
   2. The operator substitutes flow information into the equation to insure that reasonable results are obtained.

B. If a problem is found, then the database information is reviewed, and problem records are deleted before recalculating the equation.

C. The equation is then loaded by stock number into the Supervisory Computer for realtime set point control.

D. The operator also loads the maximum allowable control ranges for each Flow Loop, as well as the Flow Loop priority (i.e., the order in which to change the Flow Loop set points).

The steps performed by the supervisory computer 235 in controlling the set points as shown in FIG. 12 are as follows:

A. The Supervisory Computer checks to see if a recent cast bar exit temperature value is within tolerance.

B. If it is not, the Supervisory Computer calculates the error which is the difference between the desired temperature value and the actual temperature value.

C. The Supervisory Computer then checks to see if the zones are at their control limits, and aborts if they are (see Step J below).

D. If the zones are not at their control limits, and the error is positive, a positive increment is selected to calculate the new set point for the controlled zones.

E. If the zones are not at their control limits, and the error is negative, a negative increment is selected to calculate the new set point for the controlled zones.

F. The Supervisory Computer increments the highest priority flow loop set point by a predetermined fixed increment and calculates the expected value cast bar temperature.

G. If the expected value is not within tolerance, the error is recalculated by subtracting the actual value from the expected value.

H. Step F is repeated until the zone reaches the maximum allowable control range, or the expected cast bar temperature is within tolerance.

I. If the highest priority zone reaches the maximum allowable control range, the zone with the next highest priority is selected.

J. If all control zones reach their respective maximum allowable control ranges, and the expected value of cast bar temperature is still not within tolerance, then no more adjustments are made until the operator resets the automatic operation.

K. If the expected cast bar temperature is within tolerance, and all zones are not at their maximum control limits, the realtime zone set points are incremented by the calculated amounts, and no more adjustments are made until another sample temperature value is entered.

The preferred embodiment above describes exemplary structure for performing specific tasks in the molten metal casting process. In practice, it has been found that an industrial grade computer such as a Texas Industrial Microsystems IPC 2000 series computer is sufficient to perform the tasks of the supervisory computer 235, the specifications of which have been described hereinbefore. It has also been found that an Allen-Bradley PLC-2/30 programmable logic controller is sufficient to perform the tasks of the programmable logic controller 237. This PLC has also been described hereinbefore.

It has also been found that a suitable motorized valve 238 is a Worcester Controls electronic control valve, which includes a Worcester 73/75 actuator coupled to a valve stem and has the power to open, close, or throttle the valve, and an AF-17 autoflow electric positioner, which receives a message from a controller and interprets and transmits that message to the actuator to correct its position. A suitable flowmeter is a Fisher & Porter Mini-MAG magnetic flowmeter whose meter body is a sealed section that bolts between the manufacturer's pipeline flanges. These devices have also been described hereinbefore.

While various modifications may be suggested by those skilled in the art, it should be understood that all such modifications as reasonably and properly come within the scope of the invention disclosed herein are within the protection afforded by this patent.

What is claimed is:

1. In an apparatus for casting an elongated metal bar in a continuously advancing casting mold, a cast bar cooling control system comprising:

means for supplying a flow of coolant to the casting machine;

a plurality of coolant supply manifolds disposed about the longitudinal axis of the casting mold;

a plurality of nozzles for spraying the coolant onto said casting mold, each of said nozzles being attached to one of said manifolds;

valve means connected between said supplying means and said nozzles for regulating the flow rate of coolant sprayed onto said casting mold;

positioning means coupled to said valve means to positionally control the adjustment of said valve means;

at least one historical data base having stored therein cast bar product specifications and historical process parameters associated with the cast bar product specifications;

computing means i) for communicating control parameters to said positioning means, ii) for receiving cast bar property values, iii) for maintaining said historical data base, and iv) for performing off-line simulations to determine whether process and control parameter changes will bring the cast bar within said cast bar product specifications; and historical data generating means communicating with said computing means for providing said computing means with information reflecting a value of at least one cast bar property so that said computer means can correctly position said valve means to obtain a desired predetermined value of said cast bar property.

2. The system of claim 1, further comprising flowmeter means connected between said supplying means and said nozzle means for providing the computing means with a coolant flow rate measurand in order that said computing means can determine if said valve means is correctly positioned to achieve said desired predetermined value of said cast bar property.

3. The system of claim 2, wherein said flowmeter, said valve, and said positioning means comprise an individual coolant flow control loop, further including:

programmable logic controller means in communication with said computing means and said valve positioning means to control said valve means.

4. The system of claim 3, wherein said casting mold is axially divided into a plurality cooling zones positionally related to corresponding segments of at least one of said manifolds, further including a plurality of individual coolant flow control loops.

5. The system of claim 4, wherein at least one of said coolant flow control loops is positioned near the casting mold entry and another of said coolant flow control loops is positioned near the casting mold exit.

6. The system of claim 4, wherein each coolant flow control loop is associated with a respective cooling zone, each of said additional coolant flow control loops comprising a flowmeter, a valve, and a valve positioning means connected between said supplying means and said nozzle means for providing said controller means with the coolant flow rate measurand in order that said controller means can determine if said valve means is correctly positioned to achieve said desired predetermined value of said cast bar property.

7. The system of claim 1 wherein the cast bar property is as-cast bar temperature.

8. A method of producing a cast metal bar in a continuously advancing casting mold wherein the mold is subjected to a coolant flow for solidifying molten metal in the mold, comprising the steps of:

a) performing a first operation comprising measuring the coolant flow rate to produce a flow measurand to produce flow measurand data, and measuring a property of the as-cast bar produced according to said coolant flow rate to produce actual cast bar product specification data from cast bar property data associated with said coolant flow rate data;

b) storing said actual cast bar product specification data, said coolant flow rate data, and the associated cast bar property data in a database;

c) performing, after said first operation, a second operation in connection with said data to produce proposed coolant flow rate set-point data for producing cast bar of a predetermined property associated with a desired cast bar product specification;

d) performing, after said second operation, a third operation comprising comparison of said proposed set-point data with known limits including maximum and minimum coolant flow rate limits, casting machine speeds, and variations in the metallurgical composition of the cast bar to produce realtime set-point data;

e) communicating said realtime set-point data to said casting machine to control the coolant flow rate;

f) repeating step a) and comparing the cast bar property results with the desired cast bar product specification data; and g) adjusting the realtime set points to bring the cast bar property within desired cast bar product specification limits if necessary.

9. The method of claim 8, wherein the first operation coolant flow rate data collection is periodically repeated.

10. The method of claim 9, wherein the repetition period is less than about one minute.

11. The method of claim 8, wherein the first operation cast bar property measurement is periodically repeated.

12. The method of claim 8, wherein the casting mold is elongated and divided along its length into a plurality of cooling zones between a mold entry and a mold exit, each zone being associated with one or more coolant sources, wherein flow measurand data is obtained from at least one of said coolant sources.

13. The method of claim 12, wherein flow measurand data is obtained from the coolant source associated with the cooling zone closest to the mold entry.

14. The method of claim 12, wherein flow measurand data is obtained from the coolant source associated with the cooling zone closest to the mold.

15. The method of claim 8, wherein flow measurand data is obtained from at least one cooling zone having the most significant effect on the desired bar solidification history.

16. The method of claim 8, wherein the second operation further includes data analysis of the flow measurand data and the cast bar property data.

17. The method of claim 16, wherein the data analysis is in the form of multivariate polynomial regression, and wherein the dependent variable is the cast bar property and the independent variable is the flow measurand.

18. The method of claim 17, wherein the data analysis is in the form of a seventh-order multivariate polynomial regression.

19. The method of claim 12, wherein each cooling zone along the length of the casting mold includes a separate flow control loop and wherein each loop is separately adjustable, the steps of adjusting some of the loops independently of others.

20. The method of claim 19, further including the step of adjusting some of the loops sequentially along the casting mold path from the molten metal entry to the mold exit.

21. The method of claim 19, further including the step of prioritizing the order in which the loops are adjusted.

22. The method of claim 8, wherein the realtime set points are adjustable in increments, including in step g) the additional step of periodic incremental adjustment of the realtime set points.

23. The method of claim 8, including in step g) the additional step of calculating the difference between the desired cast bar product specification data and the cast bar property data for a given portion of the cast bar prior to adjusting the realtime set points.

24. The method of claim 23, wherein the realtime set points are adjustable in increments, including the additional steps of calculating an expected value change in the measured cast bar property for a single incremental change, comparing the expected cast bar property value with the desired cast bar property value according to the desired cast bar product specification, and increasing the size of the incremental change.

25. The method of claim 24, wherein the size of the incremental change is increased to generate a revised realtime set point and the comparison is repeated until the expected value change in the measured cast bar property is within the desired cast bar product specification, then implementing the revised realtime set point.

26. The method of claim 24, wherein the size of the incremental change is increased to generate a revised realtime set point for a given loop and the comparison is repeated until the expected value change in the cast bar property is not within the cast bar product specification and a coolant flow rate limit is reached, implementing the revised realtime set point, and repeating the calculation, comparison, and adjustment steps on another coolant flow loop.

27. The method of claim 24, wherein the number of the incremental changes is increased to generate a revised realtime set point and the comparison is repeated until the expected value change in the measured cast bar property is within the desired cast bar product specification, then implementing the revised realtime set point.

28. The method of claim 24, wherein the value of the incremental changes are accumulated to generate a revised realtime set point for a given loop and the comparison is repeated until the expected value change in the measured cast bar property is not within the desired cast bar product specification and a coolant flow rate limit is reached, implementing the revised realtime set point, and repeating the calculation, comparison, and adjustment steps on another coolant flow loop.

29. The method of claim 23, wherein the realtime set points are adjustable in fixed increments, including the additional steps of calculating an expected value change in the measured cast bar property for a single incremental change, comparing the expected cast bar property value with the desired cast bar property value according to the desired cast bar product specification, and increasing the number of increments by one.

30. The method of claim 8, wherein said cast bar property is the mold exit temperature of the cast bar.

31. Apparatus for producing cast metal bar in a continuously advancing metal casting mold wherein the bar is subjected to cooling from a coolant flow for solidification temperature control, comprising:

a) means for performing a first operation comprising measuring the coolant flow rate to produce a series of flow measurands to produce flow measurand data, and measuring a property of the cast bar produced according to said coolant flow rate to produce actual cast bar product specification data from cast bar property data associated with said coolant flow rate data;

b) database means for storing said actual cast bar product specification data, said coolant flow rate data, and the associated cast bar property data;

c) means for performing, after said first operation, a second operation in connection with said data to produce proposed coolant flow rate set-point data for producing cast bar of a predetermined property associated with a desired cast bar product specification;

d) means for performing, after said second operation, a third operation comprising comparison of said proposed set-point data with known limits including maximum and minimum coolant flow rate limits, casting machine speeds, and variations in the metallurgical composition of the bar to produce realtime set-point data;

e) means for communicating said realtime set-point data to said casting machine to control the coolant flow rate; and f) means for adjusting the realtime set points to bring the cast bar property within desired cast bar product specification limits if necessary, wherein said means for performing said second operation, said means for performing said third operation, and said means for adjusting is a computer.

32. The apparatus of claim 31, wherein said cast bar property is the mold exit temperature of the cast bar.

33. In an apparatus for casting of an elongated metal bar in a continuously advancing casting mod, a cast bar cooling control system comprising:

means for supplying a flow of coolant to the casting machine;

a plurality of coolant supply manifolds disposed about the longitudinal axis of the casting mold;

a plurality of nozzle means for spraying the coolant onto said casting mold, each of said nozzle means being attached to one of said manifolds;

valve means connected between said supplying means and said nozzle means for regulating the flow rate of coolant sprayed onto said casting mold;

positioning means coupled to said valve means for positionally controlling an adjustment of said valve means;

at least one historical data base having stored therein cast bar product specifications and historical process parameters associated with the cast bar product specifications;

computing means i) for communicating control parameters to said positioning means, ii) for receiving cast bar property values, iii) for maintaining said historical data base, and iv) for performing off-line simulations to determine whether process and control parameter changes will bring the cast bar within said cast bar product specifications; and historical data generating means communicating with said computing means for providing said computing means with information reflecting a value of at least one cast bar property so that said computer means can correctly position said valve means to obtain a desired predetermined value of said cast bar property;

wherein said off-line simulation performing means further comprises means for data analysis of coolant flow measurand data and cast bar property data in the form of a seventh-order multivariate polynomial regression of at least one independent variable and at least one dependent variable, and wherein the dependent variable is the cast bar property and the independent variable is the flow measurand, of the form:

$$t(0 \ldots f_z) = a_0 + a_1f_0 + a_2f_0^2 + a_3f_0^3 + \ldots + a_7f_0^7 + b_1f_1 + b_2f_1^2 + b_3f_1^3 + \ldots + b_7f_1^7 + c_1f_2 + c_2f_2^2 + c_3f_2^3 \ldots + c_7f_2^7 + \ldots + z_1f_z + z_2f_z^2 + z_3f_z^3 + \ldots + z_7f_z^7.$$

34. A method of producing a cast metal bar in a continuously advancing casting mold wherein the mold is subjected to a coolant flow for solidifying molten metal in the mold, comprising the steps of:

a) performing a first operation comprising measuring the coolant flow rate to produce a flow measurand to produce flow measuring and data, and measuring a property of the as-cast bar produced according to said coolant flow rate to produce actual cast bar product specification data from cast bar property data associated with said coolant flow rate data;

b) storing said actual cast bar product specification data, said coolant flow rate data, and the associated cast bar property data in a database;

c) performing, after said first operation, a second operation in connection with said data to produce proposed coolant flow rate set-point data for producing cast bar of a predetermined property associated with a desired cast bar product specification;

d) performing, after said second operation, a third operation comprising comparison of said proposed set-point data with known limits including maximum and minimum coolant flow rate limits, casting machine speeds, and variations in the metallurgical composition of the cast bar to produce realtime set-point data;

e) communicating said realtime set-point data to said casting machine to control the coolant flow rate;

f) repeating step a) and comparing the cast bar property results with the desired cast bar product specification data; and g) adjusting the realtime set points to bring the cast bar property within desired cast bar product specification limits if necessary;

wherein the second operation further includes data analysis of the flow measurand data and the cast bar property data, wherein the data analysis is in the form of a seventh-order multivariate polynomial regression of at least one independent variable and one dependent variable, and wherein the dependent variable is the cast bar property and the independent variable is the flow measurand, of the form:

$$t(0 \ldots f_z) = a_0 + a_1f_0 + a_2f_0^2 + a_3f_0^3 + \ldots + a_7f_0^7 + b_1f_1 + b_2f_1^2 + b_3f_1^3 + \ldots + b_7f_1^7 + c_1f_2 + c_2f_2^2 + c_3f_2^3 \ldots + c_7f_2^7 + \ldots + z_1f_z + z_2f_z^2 + z_3f_z^3 + \ldots + z_7f_z^7.$$

35. Apparatus for producing cast metal bar in a continuously advancing metal casting mold wherein the bar is subjected to cooling from a coolant flow for solidification temperature control, comprising:

a) means for performing a first operation comprising measuring the coolant flow rate to produce a series of flow measurands to product flow measurand data, and measuring a property of the cast bar produced according to said coolant flow rate to produce actual cast bar product specification data from cast bar property data associated with said coolant flow rate data;

b) database means for storing said actual cast bar product specification data, said coolant flow rate data, and the associated cast bar property data;

c) means for performing, after said first operation, a second operation in connection with said data to produce proposed coolant flow rate set-point data for producing cast bar of a predetermined property associated with a desired cast bar product specification;

d) means for performing, after said second operation, a third operation comprising comparison of said proposed set-point data with known limits including maximum and minimum coolant flow rate limits, casting machine speeds, and variations in the metallurgical composition of the bar to produce realtime set-point data;

e) means for communicating said realtime set-point data to said casting machine to control the coolant flow rate; and f) means for adjusting the realtime set points to bring the cast bar property within desired cast bar product specification limits if necessary, wherein said means for performing said second operation, said means for performing said third operation, and said means for adjusting is a computer, wherein the second operation further includes data analysis of the flow measured data and the cast bar property data, wherein the data analysis is in the form of a seventh-order multivariate polynomial regression of at least one independent variable and at least one dependent variable, and wherein the dependent variable is the cast bar property and the independent variable is the flow measurand, of the form:

$$f(0 \ldots f_z) = a_0 + a_1 f_0 + a_2 f_0^2 + a_3 f_0^3 + \ldots + a_7 f_0^7 + b_1 f_1 +$$

-continued $$b_2 f_1^2 + b_3 f_1^3 + \ldots + b_7 f_1^7 + c_1 f_2 + c_2 f_2^2 + c_3 f_2^3 \ldots +$$

$$c_7 f_2^7 + \ldots + z_1 f_z + z_2 f_z^2 + z_3 f_z^3 + \ldots + z_7 f_z^7.$$

* * * * *